United States Patent [19]

Nishino et al.

[11] Patent Number: 4,985,291

[45] Date of Patent: Jan. 15, 1991

[54] BURNER SKELETON

[75] Inventors: Atsushi Nishino, Neyagawa; Kunio Kimura, Hirakata; Yasuhiro Takeuchi, Hirakata; Koji Ishihara, Hirakata, all of Japan

[73] Assignee: Matsushita Electric Industrial Co., Ltd., Osaka, Japan

[21] Appl. No.: 847,199

[22] Filed: Apr. 2, 1986

Related U.S. Application Data

[62] Division of Ser. No. 578,756, Feb. 9, 1984, Pat. No. 4,595,664.

[30] Foreign Application Priority Data

Feb. 16, 1983 [JP] Japan ..... 58-24990
Jul. 18, 1983 [JP] Japan ..... 58-131239

[51] Int. Cl.[5] ..... B01D 39/20

[52] U.S. Cl. ..... 428/116; 428/428; 428/701; 428/698; 502/527

[58] Field of Search ..... 428/116, 701, 472, 432, 428/117, 104, 124, 428, 188; 501/527

[56] References Cited

U.S. PATENT DOCUMENTS

| | | | |
|---|---|---|---|
| 805,595 | 11/1905 | Thompson | 428/428 |
| 2,114,692 | 4/1938 | Ward et al. | 428/428 |
| 2,874,071 | 2/1959 | Kadish et al. | 428/432 X |
| 3,189,512 | 6/1965 | Stong | 428/428 X |
| 3,268,352 | 8/1966 | Davy et al. | 428/428 |
| 3,404,027 | 10/1968 | Kosiorek | 428/428 |
| 3,607,325 | 9/1971 | Spangler et al. | 501/124 |
| 3,824,105 | 7/1974 | Capellman et al. | 106/104 X |
| 3,962,515 | 6/1976 | Dumbaugh, Jr. et al. | 428/428 X |
| 3,995,086 | 11/1976 | Plungiuan et al. | 428/701 X |
| 4,111,711 | 9/1978 | Kiehl et al. | 106/117 X |
| 4,361,620 | 11/1982 | Newton | 428/701 X |
| 4,375,496 | 3/1983 | Nowakowski et al. | 428/701 X |
| 4,381,815 | 5/1983 | Frost et al. | 428/188 X |
| 4,396,682 | 8/1983 | Mohri et al. | 428/432 X |
| 4,403,008 | 9/1983 | Factor | 428/188 X |
| 4,404,007 | 9/1983 | Tukao et al. | 428/117 X |
| 4,411,856 | 10/1983 | Monteirth | 428/188 X |
| 4,427,728 | 1/1984 | Belmonte et al. | 428/188 X |
| 4,448,833 | 5/1984 | Yamaguchi et al. | 428/188 X |
| 4,451,517 | 5/1984 | Iroguchi et al. | 428/188 X |
| 4,455,336 | 6/1984 | Ogawa et al. | 428/188 X |
| 4,521,532 | 6/1985 | Cho | 428/116 X |
| 4,533,584 | 8/1985 | Takeuchi et al. | 428/116 |
| 4,568,595 | 2/1986 | Morris | 428/116 |

*Primary Examiner*—Nancy A. B. Swisher
*Attorney, Agent, or Firm*—Wenderoth, Lind & Ponack

[57] ABSTRACT

A burner skeleton made of a composition including calcium aluminate and a silica compound. The calcium aluminate contains 15 to 40 wt % of lime, 35 to 80 wt % of alumina and 0.3 to 20 wt % of iron oxide. The composition may include titanium oxide.

10 Claims, 1 Drawing Sheet

BURNER SKELETON

This application is a division application of Ser. No. 578,756, filed on Feb. 9, 1984, now U.S. Pat. No. 4,595,664, Jun. 17, 1986.

BACKGROUND OF THE INVENTION

The present invention generally relates to a radiant burner and, more particularly, to a refractory skeleton for use in forming the radiant burner.

An in-house heating device designed to heat a room by combustion of fuel, such as a gas stove or an oil stove, is known as equipped with a refractory skeleton for facilitating the combustion of fuel and/or radiating infrared rays. This refractory skeleton is placed adjacent the burner and adapted to be red-heated by the flame rising from the burner for facilitating the combustion of fuel and/or enhancing the radiation of infrared rays.

A refractory skeleton hitherto used is generally made of ceramics comprising a chamotte of $Al_2O_3$-$SiO_2$ system and is prepared by sintering the chamotte, after having been molded into a desired shape, at an elevated temperature higher than 1,000° C. The employment of such a high temperature is known as desirable for increasing the physical strength of the resultant skeleton, but has been found resulting in the reduction of the porosity with no air being substantially mixed. Accordingly, it has long been a customary practice to add an expanding agent to the chamotte, or to employ a reduced sintering temperature, to make the resultant skeleton full of pores even though the physical strength thereof may be sacrificed a certain extent. This means that the prior art burner skeleton when heated to a red-hot state, is fragile and is easy to fracture.

In addition, since the chamotte does not exhibit a chemical bonding ability, a honeycomb structure molded from the chamotte has shown that the partition walls separating a multiplicity of parallel closely adjacent channels from each other in the honeycomb structure have a wall thickness of greater than 1 mm, with the consequent porosity being lower than 40%. Therefore, the ceramic skeleton has a relatively large heat capacity, requiring a relatively long time for it to be substantially red-heated subsequent to the start of heating, or sometimes failing to attain a red-hot state.

In view of the foregoing, various attempts have been made to add silica-alumina fibers with a view to increasing the physical strength, or to form a multiplicity of pyramid-shaped or conical projections on the surfaces of the skeleton with a view to enhancing the red-hot state. Even these attempts were found to be unsatisfactory in eliminating the above discussed problems.

SUMMARY OF THE INVENTION

Accordingly, the present invention has been developed with a view to substantially eliminating the above discussed disadvantages and inconveniences inherent in the prior art burner skeleton and has for its essential object to provide an improved composition for a burner skeleton, which can be used to manufacture the burner skeleton with no need to employ a sintering process.

Another object of the present invention is to provide an improved composition of the type referred to above, utilizeable in the manufacture of the burner skeleton which can, when in use, minimize the emission of obnoxious exhaust gases, resulting from the combustion of fuel, with increased efficiency in radiating the infrared rays.

The improved composition for the burner skeleton according to the present invention is in fact effective to substantially eliminate the disadvantages inherent in the prior art. However, since the burner skeleton according to the present invention is manufactured so as to have a minimized wall thickness, it may happen that depending on the application the burner skeleton may fail to have a sufficient physical strength at the surfaces thereof.

Accordingly, it is a further important object of the present invention to provide an improved burner skeleton which is effective to eliminate the above described possible disadvantage, which can be manufactured with no need to employ a sintering process, which when in use minimizes the emission of the obnoxious exhaust gases with increased efficiency in radiating the infrared rays, and which has an increased physical strength.

According to the present invention, a burner skeleton comprises a molding prepared from a composition of a silica compound and a calcium aluminate as a binder, and if desired, a titanium oxide. Depending on the application, for improving the surface hardness, the molding may be subjected to a surface hardening process to form a layer of heat-resistant inorganic substance.

The calcium aluminate referred to above is also called alumina cement and has a higher heat resistance than that of a well known Portland cement. For example, the calcium aluminate exhibits its stability even at 1,000° C. The most important merit derived from the employment of the alumina cement in the present invention as a binder lies in that the molding can be prepared without having been sintered, i.e., with no need to employ any sintering process. The molding of alumina cement so formed without having been sintered has a relatively large BET specific surface area, for example, about 40 $m^2/g$, and such porosity is desirable in terms of the mixing of fuel with air in this type of burner. In addition, so far as the catalytic action of the alumina cement is concerned, it is a solid basic catalyst featured in that it works out to convert hydrocarbon having a large number of carbon atoms into hydrocarbon having a small number of carbon atoms, that is, it works as a cracking catalyst. This means that the alumina cement has a capability, as a catalyst, of facilitating the combustion of fuel, and that is the reason that the burner skeleton manufactured with the use of the composition according to the present invention can minimize the emission of obnoxious components of the exhaust gases as compared with the prior art product of similar kind.

The calcium aluminate employed in the practice of the present invention contains iron oxide as an impurity. This iron oxide has a catalytic action. Therefore, while oil being burned produces unburned exhaust gases when extinguished, the unburned exhaust gases can be oxidized, and substantially purified, by the effect of the accumulated heat even after the extinguishment because the material constituting the burner skeleton according to the present invention has a catalytic action.

As hereinabove discussed, the calcium alumina as a whole can act as both a cracking catalyst and an oxidizing catalyst and, because of this, the emission characteristic is rendered acceptable. By way of example, the $CO/CO_2$ value has been found to be $1/10 \sim 1/100$ of that stipulated in the Japanese Industrial Standards (JIS, setting forth the $CO/CO_2$ value to be smaller than 0.02). In addition, a low temperature catalytic combustion is possible and, accordingly, the emission of NOx can be reduced to 1/10 to 1/100 of that exhibited by the prior art burner.

Hereinafter, the silica compound will be described. The silica compound contains a heat-resistant base aggregate comprising $SiO_2$. Although the calcium aluminate may be singly employable to form the molding, the physical strength, the heat resistance and the spalling resistance can be improved when the calcium aluminate is used in combination with the silica compound. Accordingly, in view of the fact that the burner skeleton according to the present invention is, when in use, exposed to an elevated temperature for a long time, the silica compound is an essential element in the composition for the burner skeleton according to the present invention.

The titanium oxide may be employed in the practice of the present invention if desired because it serves, when used, to increase the heat resistance of the alumina cement, to enhance the activity of the cracking catalyst, and to increase the heat resistance due to the increased specific surface area of the burner skeleton and because it is excellent in efficiency of radiating infrared rays. Although the alumina cement is excellent in heat resistance, it is susceptible to sintering with the consequent decrease in specific surface area when used for a long time. On the contrary thereto, the titanium oxide has a melting point of not lower than 1,800° C., and is, therefore, stable at a temperature to which the burner skeleton may be heated when in use. Since the titanium oxide exists among particles of the alumina cement, any possible sintering of the alumina cement can advantageously be suppressed, and the composition as a whole is imparted the increased heat resistance with no apparent reduction in specific surface area even after the use for a long time. An important feature of the titanium oxide lies in that, since it has an excellent radiating efficiency, heat energies produced as a result of the combustion can be converted into radiant heat in a great quantity.

Hereinafter, the details of each of the calcium aluminate, the silica compound and the titanium oxide will be discussed.

The binder used in the manufacture of the burner skeleton according to the present invention is the calcium aluminate generally represented by alumina cement which is quite different from Portland cement. The alumina cement is generally expressed by a chemical formula, $mAl_2O_3.nCaO$, in contrast to $m'SiO_2.n'CaO$ which is the chemical formula of Portland cement. Although Portland cement is readily available and relatively inexpensive, it cannot withstand the elevated temperature of 300° C. or higher and, therefore, is low in heat resistance, spalling resistance and curing speed. In addition, the Portland cement is susceptible to erosion by the action of sulfate ions. In contrast thereto, the alumina cement can withstand the elevated temperature of 300° C. or higher, and has a high curing speed and is considered a desirable cement for making a catalyst.

While the alumina cement has such a composition as hereinbefore described, if the CaO content is not more than 40 wt %, the physical strength can be increased, but not only is the heat resistance reduced, but it tends to react with heavy metal oxides, to be added as impurities, at the elevated temperature. For example, when heated at about 1000° C. or higher, an iron oxide added thereto is transformed into $CaFe_2O_4$ or the like which will trigger the thermal decomposition of the composition for the burner skeleton. On the contrary thereto, if the CaO content is small, the heat resistance can be increased, but not only is the physical strength reduced, but the curing time during the molding becomes prolonged, thereby reducing the productivity. On the other hand, if the aluminum content is not more than 35 wt %, the heat resistance will be reduced, but if it is high, the heat resistance can be improved. In order to make it possible to withstand the temperature of about 800° C. or higher, the alumina cement having a high alumina content is desirable.

When the amount of iron oxide added is greater than 20 wt %, not only is the physical strength reduced during the heating accompanied by the reduction in heat resistance, but also the burner skeleton tends to be aesthetically badly colored. This iron oxide exhibits a catalytic effect for purifying, for example, carbon monoxide, at a temperature of about 300° C. or higher. Therefore, in order for the iron oxide to exhibit such a catalytic effect, the minimum preferred amount thereof is preferably 2 wt %.

A preferred alumina cement contains CaO in an amount within the range of 15 to 40 wt %, preferably 30 to 40 wt %, alumina in an amount within the range of 35 to 80 wt %, preferably 40 to 60 wt %, and iron oxide in an amount within the range of 0.3 to 20 wt %, preferably 2 to 10 wt %.

The titanium oxide employed in the practice of the present invention is to be understood as including compound oxides containing titanium oxide.

The titanium oxide is available in the form of $Ti_2O$, TiO, $Ti_2O_3$, $Ti_3O_5$ and $TiO_2$ and, of them, $TiO_2$ exists in a stabilized form. $TiO_2$ includes crystalline modifications such as anatase, brookite and rutile and these three crystalline modifications are available either in nature or artificially. Especially, the rutile type is stable at the elevated temperature, and the transformation of the anatase type into the rutile type takes place at about 700° C. Although any one of these modifications of $TiO_2$ can be employed in the practice of the present invention, the rutile type is preferred because of its excellent thermal stability.

The compound oxides of titanium oxide include $TiO_2$-$Al_2O_3$, $TiO_2$-$ZrO_2$, $TiO_2$-$SiO_2$, $TiO_2$-MgO, $TiO_2$-$Bi_2O_3$, $TiO_2$-CdO, $TiO_2$-$SnO_2$ and so on, and any one of them can be utilized in the practice of the present invention.

The rutile type of $TiO_2$ has a crystalline structure of tetragonal system and has a melting point of 1,855° C. The naturally yielded $TiO_2$ has a specific surface area of about 10 $m^2/g$. Since the melting point is as high as 1,855° C. although the specific surface area is not so large, both the reduction in surface area resulting from the sintering and the growth of particulates of calcium aluminate appear to be suppressed during the normal use.

The content of titanium oxide in the practice of the present invention is preferred to be not less than 3 wt %, and if it is not higher than 3 wt %, no effect can be derived from the addition of the titanium oxide. Conversely, if it is not less than 40 wt %, the amount of the calcium aluminate is reduced with the consequent reduction in the bonding ability and, therefore, the resultant burner skeleton can no longer be useable in practice. This titanium oxide is mixed together with the calcium aluminate with the use of water in a quantity sufficient to enable the mixture to be molded, the mixture being, after having been molded into any desired shape, cured to harden.

With respect to the slica compound, it is to be understood as including not only $SiO_2$ alone, but also any material containing $SiO_2$ as its main ingredient. Although $SiO_2$ exists in nature in the form of silica and silica sand, a powdery synthetic fusion silica may be also employed in the practice of the present invention. Other than those mentioned above, the silica compound utilizeable in the practice of the present invention is also to be understood as including silicate compounds such as for example, magnesium silicate and calcium silicate. Minerals containing silica as one ingredient thereof such as, for example, chamotte, clay, agalmatolite, mulite, and silimanite may also be used in the practice of the present invention. Any of these silica compounds is, when in contact with calcium aluminate, chemically bonded together therewith, thereby rendering the resultant skeleton to have a higher physical strength than that exhibited by the skeleton prepared by the sole use of the calcium aluminate.

In the present invention, the composition for the burner skeleton may, in addition to the essential mixture of calcium aluminate and silica compound, contain titanium oxide in an amount not more than 40 wt %. If desired for the purpose of increasing the heat resistance and the thermal shock resistance, one or a mixture of fibers of inorganic compounds such as, for example, alkali-proof glass fibers, silica-alumina fibers, asbestos, and alumina fibers may also be added to the composition for the burner skeleton.

In addition, as a molding auxiliary, one or a mixture of such additives as including, for example, carboxymethylcellulose, methylcellulose, polyvinyl alcohol, glycerine, various alcohols, a clay such as bentonite, and minerals may also be employed.

The surface hardening treatment for forming a hardened surface layer on the surface of the burner skeleton will now be described.

The hardened surface layer is a coating formed on the surface of the burner skeleton for increasing the hardness of the skeleton surface, for minimizing or substantially eliminating the surface chipping or desquamation of the burner skeleton, and also for improving the infrared radiating characteristic. The surface of the burner skeleton on which the hardened surface layer is to be formed may be the entire surface thereof. However, since when the entire surface of the burner skeleton is covered by the hardened surface layer, each material included in the composition for the burner skeleton will not exhibit its characteristic effect, it is preferred for the hardened surface layer to be partially formed on the surface of the burner skeleton. More specifically, the hardened surface layer is preferably formed either on a surface area of the burner skeleton opposite to the surface area to which fuel is supplied, or in the form of insular deposits scattered all over the entire surface of the burner skeleton. By so forming, each material included in the composition for the burner skeleton can be allowed to exhibit its characteristic effect and, therefore, the problems hereinbefore discussed can advantageously be eliminated, accompanied by the improvements in performance.

The surface hardening treatment to form the hardened surface layer may be carried out by the use of a plasma spray coating technique, a painting technique, or a dipping technique. The plasma spray coating technique is a technique wherein a ceramic material as will be described later is introduced into plasma flames of 5,000° to 20,000° C. to allow it to be fused, the fused ceramic material being in turn deposited on the surface of the burner skeleton. Other than the plasma spray coating technique, an arc spray coating technique and a flame spray coating technique are also available, but the use of the plasma spray coating technique is preferred to achieve the intended objects of the present invention because the sprayed powdery material can exhibit a strong bonding with the workpiece.

Preferably, the plasma spray coating is performed in the presence of argon gas, argon-hydrogen gas or a gas of argon-helium system, and the gas of argon-helium system being more preferred. In addition, during the plasma spray coating, it is preferred that the secondary winding produces a direct current of not lower than 30V and not lower than 600A.

The ceramic material to be used in the practice of the plasma spray coating technique is one or a mixture of such metal oxides as $Al_2O_3$, $TiO_2$, $SiO_2$, $ZrO_2$, MgO, NiO, CaO and $Cr_2O_3$ or a compound oxide such as, for example, $MgAl_2O_4$, $MgZrO_3$ and $CaZrO_3$ In any event, the ceramic material is preferred to be 10 to 100$\mu$m in particle size.

Where the painting or dipping technique is employed, the resultant hardened surface layer may be of glass material. When to be applied, the glass material is pulverized into fine particles and then prepared into a slip containing mill additives, which slip is painted or applied by dipping to the burner skeleton. After the application of the slip, the burner skeleton is baked at a predetermined temperature. One thing to note when the glass material is to be employed is that the glass material should be the one having a coefficient of thermal expansion about the same as that of the composition for the burner skeleton. The glass material referred to above is to be construed as including that which is, when being sintered or after having been sintered, crystallized, that is, a so-called crystal glass. For forming the glass material, a solution of metallic alkoxide may be employed. The metallic alkoxide solution is an alkoxide group bonded with positive ions and includes, for example, $Si(OC_2H_5)_4$, $Ti(OC_3H_7)_4$, $Ge(OC_2H_5)_4$, and $Zr(OC_3H_7)_4$. When hydrolyzed, this forms a sol in which metal and oxygen are bonded together and is then gelatinated upon polymerization. When at this stage, the solution is applied to the burner skeleton and is then dehydrolyzed by heating it to about 500° C., the glass material can be obtained.

Heat resistant inorganic paints may also be employed as a material for the hardened surface layer. These paints are available in water-glass type and phosphor acid type. The water-glass type is a mixture of water-glass with a heat-resistant inorganic material such as, for example, alumina, which may contain a pigment if desired.

The phosphor acid type is the one generally expressed by the formula, $Mo.xP_2O_5.yH_2O$, wherein M is at least one selected from the group consisting of Al, Mg, Ca, Fe, Cu, Ba, Ti, Mn and Zn. Any one of these phosphor acid type compounds is transformed into a condensed phosphate having a high molecular weight when heated, but is crystallized and then hardened when heated at an elevated temperature. By way of example, aluminum primary phosphate will be transformed into $Al_2O_3.3P_2O_5$ at 500° C., but into $Al_2O_3.P_2O_5$ at a temperature equal to or higher than 1,000° C.

For the sake of brevity, only reference to the colloidal silica and colloidal will be made as a material for the hardened surface layer.

The colloidal silica is a colloidal aqueous solution in which electrically negative-charged, amorphous particles of silica, each particle having a —SiOH group and —$OH^-$ ions present on the surface thereof, are dispersed and wherein an electric double layer is formed by alkali ions and the particles are stabilized by the repellent action developed among the particles. When this solution is applied to the burner skeleton, the equilibrium of electric charges is destroyed so that the particles are bonded together with the consequent increase of the viscosity thereof to coagulate through the process of gellatination and, accordingly, $SiO_2$ or $Al_2O_3$ layer is formed on the surface of the burner skeleton. The use of any one of the colloidal silica and the colloidal alumina is advantageous in that, when applied over the intended surface area of the burner skeleton, it forms insular layers of surface hardening inorganic material permitting the composition of the burner skeleton to exhibit its characteristic effect.

The hardened surface layer according to the present invention can be formed by the use of any one of the numerous methods described hereinbefore. However, no matter what method is employed, it is important that the hardened surface layer when formed on the burner skeleton should not be such as to counterbalance the characteristic action of the composition for the burner skeleton. Therefore, where a uniform hardened surface layer is desired, it should be formed on one surface of the burner skeleton, and where the hardened surface layer is formed in the form of the insular deposits over the entire surface of the burner skeleton, it is necessary to render each insular deposit to have a small thickness.

Since the composition according to the present invention can be molded into a desired shape without being sintered, the burner skeleton is preferred to have a honeycomb structure. The prior art burner skeleton having a honeycomb structure is generally made of alumina or cordierite, and the manufacture thereof requires the employment of the sintering process. Therefore, the prior art burner skeleton of honeycomb structure has a small specific surface area and is expensive.

On the contrary thereto, the composition according to the present invention does not require the employment of the sintering process during the manufacture and is an effective material for the burner skeleton having a high physical strength and also a high hardness. Therefore, with the composition according to the present invention, it is possible to manufacture the burner skeleton of honeycomb structure wherein a wall thickness of each partition wall among the closely adjacent parallel passages is relatively small, and accordingly, the surface area of a value 10 or more times the apparent surface area of a unitary block of the honeycomb structure can be obtained.

The burner skeleton having the increased surface area is advantageous for the following reasons. That is, if the surface area is small, combustion may take place at a local region of the burner skeleton and the temperature at such local region elevates, resulting in the increased emission of NOx. The emission of NOx is closely related to the combustion temperature and increases when the temperature attains a value higher than 1,100° C. On the contrary thereto, if the surface area is great, the combustion is distributed and the temperature is consequently lowered. In view of the above, according to the present invention, it is possible to suppress the combustion temperature to a value lower than 900° C. and, accordingly, the emission of NOx can be minimized to 1/10 to 1/100 of that observed with the prior art burner skeleton. In general, in a combustion burner, the emission of NOx and the emission of unburned components of CO and HC have a relationship reverse to each other and, when the emission of NOx is suppressed, the emission of CO and HC tends to increase. However, since the composition according to the present invention can act as a cracking catalyst as hereinbefore described, it is possible to achieve a combustion with no CO and HC components being emitted even at a low temperature. Moreover, for the purpose of facilitating the mixing with oxygen, the burner skeleton made of the composition according to the present invention has a BET surface area as large as 40 $m^2/g$ and is porous. Therefore, no rise of flames which would result from the shortage of oxygen occurs and the combustion takes place at the surface of the burner skeleton, that is, a so-called surface burning takes place, with heat energies effectively and efficiently converted into radiant heat by the composition of the present invention.

By the reasons stated above, it is preferred for the burner skeleton, made of the composition of the present invention, to satisfy the following requirements. In the first place, the burner skeleton has a honeycomb structure including a plurality of through-holes spaced from each other by wall thicknesses not exceeding 1 mm, it being, however, to be understood that, even though the term "honeycomb structure" is herein employed, the cross-sectional shape of each of the through-holes in the honeycomb structure is not always limited to the hexagonal shape, but is to be construed as including any other shape such as, for example, square and circular shapes. The reason that the wall thickness is selected not exceeding 1 mm is because, if it is greater than 1 mm, the apparent geometrical surface area cannot be increased and the surface burning cannot be expected. Preferably, the wall thickness is to be within the range of 0.4 to 0.8 mm, and if it is smaller than 0.4 mm, the physical strength will be reduced.

The porosity of the through-holes is preferably within the range of 50 to 82% of the apparent cross-sectional surface area of the burner skeleton. If it is smaller than 50%, the surface burning can not be expected as is the case with the burner skeleton made of the conventional composition and the temperature raise takes place at a local area with the consequence of the increased NOx emission. On the contrary thereto, if it is greater than 82%, the burner skeleton will have an extremely thin wall and will become fragile.

As regards the BET specific surface area of the burner skeleton, it means the surface area measured according to the BET method (the surface area calculated from the amount of $N_2$ absorbed at 77K) and is different from the geometrical surface area. In the present invention, the BET specific surface area is preferred to be 5 $m^2/g$ or more. While according to the present invention by suitably selecting the mixing ratio of calcium aluminate, silica compound and titanium oxide it is possible to make burner skeletons having different specific surface areas, the objects of the present invention cannot be accomplished by the above described reasons if the burner skeleton fails to have the minimum specific surface area of 5 $m^2/g$.

According to the present invention, the following advantages can be appreciated.

(1) Reduction of unburned CO and HC—Since the burner skeleton made of the composition of the present invention has a large specific surface area, it can provide an effective source of air. In addition, the calcium aluminate and iron oxide both contained in the composition act as an oxidizing catalyst.

(2) Reduction of Nox—Because of the increased surface area at which combustion takes place, the surface burning takes place in the burner skeleton at a low combustion temperature.

(3) Increased radiant heat—Because of the employment of titanium oxide excellent in radiating characteristic and because of the improvement in the wall thickness and the porosity of the honeycomb structure, the heat capacity is reduced.

(4) Oxidizing catalytic effect after extinguishment—Where oil (petroleum) is used as fuel, the effect is exhibited and iron oxide contained in the alumina cement is effective.

(5) Surface burning—Since the calcium aluminate acts as a cracking catalyst to crack into hydrocarbon having small carbon atoms which facilitates the combustion of fuel, the surface burning takes place in the burner skeleton with no flame rise being accompanied and with the effective conversion into radiant heat being accompanied.

(6) Increased heat value per unit surface area of the burner skeleton—While the heat value per unit surface area of the prior art burner skeleton is 16 to 24 Kcal/cm$^2$, that according to the present invention is 7 to 40 Kcal/cm$^2$.

(7) Increased physical strength and heat resistance—While the prior art is such that the bonding force depends on the sintering, the present invention is such that the bonding is based on the chemical bonding force.

(8) Reduced price—Since the base material is alumina cement and it can be molded without being sintered, the low price can be realized.

(9) Since the hardened surface layer is formed on the surface which requires a sufficient hardness and countermeasures for avoiding any possible surface chipping or desquamation, a stabilized combustion can be guaranteed for a prolonged period of use.

The present invention having the numerous advantages described above can be used not only in a gas combustion burner, but also in an oil combustion burner and a heat source burner for a portable catalytic hair curler.

BRIEF DESCRIPTION OF THE DRAWINGS

These and other objects and features of the present invention will become clear from the following description taken by way of examples with reference to the accompanying drawings, in which.

DETAILED DESCRIPTION OF THE EMBODIMENTS

The present invention will be described by way of examples which are not intended to limit the scope thereof, but are set forth only for the purpose of illustration thereof.

EXAMPLE 1

Figure 1:
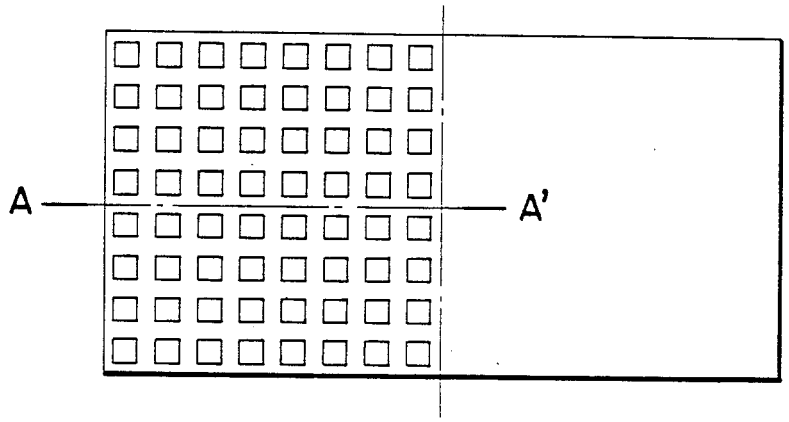
FIG. 1 is a plan view of a radiant burner skeleton of plate-like shape according to the present invention.
Figure 2:
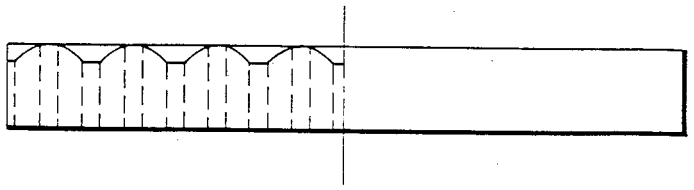
FIG. 2 is a cross-sectional view taken along the line A—A in FIG. 1.

The composition, tabulated in Table 1, was kneaded and molded by the use of an extruding machine into a plate-shaped skeleton of honeycomb structure as shown in FIGS. 1 and 2. The resultant skeleton was 4.5 cm in width, 9.5 cm in length and 1 cm in thickness and had square-sectioned through-holes, 1.4 mm×1.4 mm in sectional size, extending completely through the thickness thereof and spaced from each other by wall thicknesses of 0.5 mm. The porosity and the specific surface area were 72% and 42 m$^2$/g, respectively. The burning surface of the resultant skeleton is provided with a plurality of recesses, 1.5 mm in depth, at intervals of 1.9 mm in pitch in both lengthwise and widthwise directions.

TABLE 1

| | |
|---|---|
| Alumina Cement | 40 parts by weight |
| Silica ($SiO_2$) | 40 parts by weight |
| Titanium Oxide (Rutile type) | 5 parts by weight |
| Magnesium Silicate | 20 parts by weight |
| Glycerin | 2 parts by weight |
| Water | 40 parts by weight |

Two identical plate-like skeletons of the construction described above were, for the purpose of determining the exhaust gas emission characteristic, placed on an oil burner in such a way that flammable gas could flow from the rear surfaces of the skeletons opposite to the burning surfaces thereof into the through-holes and burn at the burning surfaces. At that time, the burner was adjusted to 2000 Kcal per item, and the exhaust gases were measured at a place spaced 20 cm from the burner.

The result of the measurement has shown that the ratio of $CO/CO_2$ was 0.0004 and the emission of NOx ($NO+NO_2$) was 0.03 ppm.

No cracking was observed in the skeletons after 300 hours of continued burning.

EXAMPLE 2

The burner skeleton of the same structure as in Example 1 was molded by the use of the composition tabulated in Table 2.

TABLE 2

| | |
|---|---|
| Alumina Cement | 45 parts by weight |
| $SiO_2$ (Molten Silica manufactured by Denki Kaguku K.K.) | 40 parts by weight |
| Magnesium Silicate | 20 parts by weight |
| Glycerin | 3 parts by weight |
| Water | 35 parts by weight |

In the same manner as in Example 1, the emission characteristic was measured and, as a result, the ratio of $CO/CO_2$ was 0.0003 and the emission of NOx was 0.1 ppm.

EXAMPLE 3

Using the composition as in Table 2, the four burner skeletons of honeycomb structure each having the porosity of 82% and the through-holes spaced from each other by wall thickness of 0.4 mm were prepared. In order to determine the relationship between the porosity and the exhaust gas emission, three of them were modified by clogging some of the through-holes with inorganic ceramics so as to reduce the porosities of 82% down to 48%, 50% and 70%. The results of the tests have shown that the $CO/CO_2$ ratio of each of the skeletons of 50, 70 and 82% in porosity, respectively, was 0.0002 to 0.0008, but that of 48% in porosity was 0.008 with the CO concentration considerably increased. Thus, it is clear that the porosity is preferred to be within 50 to 82%.

EXAMPLE 4

The burner skeletons of honeycomb structure of the composition tabulated in Table 1, but wherein without departing from the total amount of silica and titanium oxide being 45 parts by weight, the amount of titanium oxide was adjusted to 2, 3, 10, 30, 40 and 42 parts by weight, were prepared. The burner skeletons so prepared were installed on the burners as in Example 1 and were observed as to the brightness during the red-hot condition thereof. The results have shown that the brightness increased with increase of the amount of the titanium oxide added. However, after the lapse of 3,000 hours subsequent to the start of the test, cracking was observed in the burner skeleton containing 42 parts by weight titanium oxide and, in fact, it was fragile. Accordingly, it can be stated that the amount of the titanium oxide to be added in the composition of the present invention is preferred not to exceed 40 wt % relative to the solid of the burner skeleton molded.

EXAMPLE 5

Four burner skeletons having their specific surface areas of 2.8, 4.8, 5.1 and 12 $m^2/g$, respectively, were prepared by molding the same composition as in Example 1 and baking at 1,200° C. The resultant burner skeletons were installed on the burners and were observed as to the combustion condition. The results have shown that flame rise took place in the burner skeletons of 2.8 and 4.8 $m^2/g$ in specific surface area and that the burner skeletons of 2.8 and 4.8 $m^2/g$ in specific surface area exhibited the $CO/CO_2$ ratio two to four times that of any one of the burner skeletons of 5.1 and 12 $m^2/g$ in specific surface area. Accordingly, it is clear that the burner skeleton according to the present invention is preferred to have a specific surface area not smaller than 5 $m^2/g$.

EXAMPLE 6

The composition, tabulated in Table 3, was kneaded and molded by the use of an extruding machine into a plate-shaped skeleton of honeycomb structure as shown in FIGS. 1 and 2. The resultant skeleton was 4.5 cm in width, 9.5 cm in length and 1 cm in thickness and had square-sectioned through-holes, 1.5 mm×1.5 mm in sectional size, extending completely through the thickness thereof and spaced from each other by wall thicknesses of 0.5 mm. The porosity and the specific surface area were 74% and 36 $m^2/g$, respectively.

TABLE 3

| | |
|---|---|
| Alumina Cement | 40 parts by weight |
| Silica ($SiO_2$) | 60 parts by weight |
| Glycerin | 2 parts by weight |
| CMC | 1 parts by weight |
| Water | 38 parts by weight |

Two identical burner skeletons of the construction described above were, for the purpose of determining the exhaust gas emission characteristic, placed on the oil burner which was adjusted to 200 Kcal per item, and the exhaust gases were measured at a place spaced 20 cm from the burner.

The result has shown that the $CO/CO_2$ ratio was 0.001 and the emission of NOx ($NO+NO_2$) was 0.05 ppm.

No cracking was observed in the burner skeletons after 3,000 hours of continued burning. However, the molding speed per unit time can be increased 30% in Example 1, but the burner skeleton in Example 6 can be satisfactorily molded without the addition of titanium oxide if the molding speed is lowered. In addition, since no titanium oxide was employed, the exhaust gas emission characteristic was somewhat lowered.

EXAMPLE 7

The two burner skeletons of the composition as in Table 1 and molded as in Example 1 were coated on one surface thereof with $Al_2O_3$ by the use of a plasma spray coating technique. For the purpose of determining the exhaust gas emission characteristic, these burner skeletons were placed on an oil burner which was adjusted to 2,000 Kcal per item, and the exhaust gases were measured at a place spaced 20 cm from the burner.

The result of measurement has shown that the $CO/CO_2$ ratio was 0.00038 and the emission of NOx ($NO+NO_2$) was 0.035 ppm. No cracking was observed after 300 hours of continued burning.

EXAMPLE 8

The burner skeleton of the same structure as in Example 1 was molded by the use of the same composition as in Table 2. A slip of a composition tabulated in Table 4 was sprayed onto one surface of the burner skeleton by a spraying method and, after having been dried, the burner skeleton was then baked for 5 minutes at 850° C. to make the sprayed slip to transform into a glassy material.

TABLE 4

| | |
|---|---|
| Frit ($\alpha = 80 \times 10^{-7}$ cm/deg) | 100 parts by weight |
| Alumina ($Al_2O_3$) | 30 parts by weight |
| Clay | 7 parts by weight |
| Sodium Nitrite | 0.2 parts by weight |
| Urea | 0.5 parts by weight |
| Water | 45 parts by weight |

The burner skeleton so prepared was tested in the same manner as in Example 1, and the result has shown that the $CO/CO_2$ ratio was 0.0004 and the emission of NOx was 0.1 ppm.

EXAMPLE 9

Using the composition as in Table 2, four burner skeletons of honeycomb structure each having the porosity of 82% and the through-holes spaced from each other by wall thicknesses of 0.4 mm were prepared. In order to determine the relationship between the porosity and the exhaust gas emission, three of them were modified by clogging some of the through-holes with inorganic ceramics so as to reduce the porosities of 82% down to 48, 50 and 70%. The results of the tests have shown that the $CO/CO_2$ ratio of each of the skeletons of 50, 70 and 82% in porosity, respectively, was 0.0002 to 0.0008, but that of 48% in porosity was 0.008. Thus, it is clear that the porosity is preferred to be within the range of 50 to 82%.

EXAMPLE 10

The burner skeletons of honeycomb structure of the composition tabulated in Table 1, but wherein without departing from the total amount of silica and titanium oxide being 45 parts by weight, the amount of titanium oxide was adjusted to 2, 3, 10, 30, 40 and 42 parts by weight, were prepared. The surface hardening treatment was then carried out in the same manner as in Example 7. The burner skeletons so prepared were installed on the burners as in Example 1 and were observed as to the brightness during the red-hot condition thereof. The results have shown that the brightness increased with increase of the amount of the titanium oxide added. However, after the lapse of 3,000 hours of continued burning, cracking was observed in the burner skeleton containing 42 parts by weight titanium oxide and, in fact, it was fragile. Accordingly, it can be stated that the amount of titanium oxide to be added in the composition of the present invention is preferred not to exceed 40 wt % relative to the solid of the burner skeleton molded.

EXAMPLE 11

Four burner skeletons having their specific surface areas of 2.5, 4.6, 5.1 and 11 $m^2/g$, respectively, were prepared by molding the same composition as in Example 1 and baking at 1200° C. The resultant burner skeletons were installed on the burners and were observed as to the combustion condition. The results have shown that flame rise took place in the burner skeletons of 2.5 and 4.6 $m^2/g$ in specific surface area and that the burner skeletons of 2.5 and 4.6 $m^2/g$ in specific surface area exhibited the $CO/CO_2$ ratio two to four times that of any one of the burner skeletons of 5.1 and 11 $m^2/g$ in specific surface area. Accordingly, it is clear that the burner skeleton according to the present invention is preferred to have a specific surface area not smaller than 5 $m^2/g$.

EXAMPLE 12

Using the composition as in Table 3, the two burner skeletons of honeycomb structure were prepared by an extruding machine. The skeletons were then dipped into a coloid silica solution and were, after having been dried, baked for 30 minutes at 500° C.

Each of the resultant burner skeletons was 4.5 cm in width, 9.5 cm in length and 1 cm in thickness and had square-sectioned through-holes, 1.5 mm×1.5 mm in sectional size, spaced from each other by wall thicknesses of 0.5 mm, the porosity and the specific surface area being 74% and 24 $m^2/g$, respectively.

These burner skeletons were installed on oil burners, which were adjusted to 2,000 Kcal per item, to determine the exhaust gas emission characteristic. The measurement was carried out at a place spaced 20 cm from the burners.

The results have shown that the $CO/CO_2$ ratio was 0.002 and the emission of NOx ($NO+NO_2$) was 0.04 ppm. No cracking was observed in the burner skeletons after 3000 hours of continued burning. However, the molding speed per unit time can be increased 30% in Example 1, but the burner skeletons in Example 12 can be satisfactorily molded even with no titanium oxide employed if the molding speed is lowered. In addition, since no titanium oxide was employed, the exhaust gas emission characteristic was somewhat lowered.

EXAMPLE 13

Using the same composition as in Table 1, the burner skeletons of the same structure as in Example 12 were prepared. These burner skeletons were sprayed with an inorganic paint, containing water glass and alumina, on one surface thereof and were, after having been dried, baked for 30 minutes at 300° C. These skeletons were tested in the same manner as in Example 12, and the results have shown that the $CO/CO_2$ ratio was 0.004 and the emission of NOx ($NO+NO_2$) was 0.06 ppm.

EXAMPLE 14

The same burner skeletons as in Example 12 were formed with a hardened surface layer by the use of a heat resistant inorganic paint of aluminum primary phosphate type. The baking time and temperature were 30 minutes and 500° C., respectively.

The burner skeletons so prepared were tested and evaluated in the same manner as in Example 13, and as a result it has been found that the $CO/CO_2$ ratio was 0.005 and the NOx emission was 0.008 ppm. Neither cracking nor desquamation was observed after 3000 hours of continued burning.

EXAMPLE 15

In Example 7, instead of the use of the plasma spray coating of $Al_2O_3$, the surface hardening treatment was carried out using ethyl silicate ($Si(OC_2H_5)_4$). The composition of the solution was 25 g ethyl silicate, 37.5 g $C_2H_5OH$, 23.5 g $H_2O$ and 0.3 g HC.

This solution was applied in the same manner as in Example 13, and the burner skeletons so applied were baked for 30 minutes at 500° C. to allow the solution to transform into a glassy material.

The burner skeletons were evaluated in the same manner as in Example 13 and have shown that the $CO/CO_2$ ratio was 0.004 and the NOx emission was 0.006 ppm with neither cracking nor desquamation occurring even after 3000 hours of continued burning.

From the foregoing, it has now become clear that the composition according to the present invention is effective to produce a burner skeleton easy to manufacture, less in emission of obnoxious exhaust gases during the combustion, having the maximized efficiency in infrared ray radiation and with the minimized possibility of desquamation.

Although the present invention has fully been described by way of the illustrative examples, it is to be noted that various changes and modifications are apparent to those skilled in the art. Such changes and modifications are to be understood as included within the scope of the present invention as defined by the appended claims, unless they depart therefrom.

What is claimed is:

1. A burner skeleton having a porous honeycomb structure including a plurality of through-holes spaced from each other by a wall thickness not exceeding 1 mm, said burner skeleton molded from a composition comprising calcium aluminate and a silica compound, said calcium aluminate containing 15 to 40 weight % of lime, 35 to 80 weight % of alumina and 0.3 to 20 weight % of iron oxide, said molded composition comprising an inorganic hardened surface layer formed on one surface of the molding.

2. A burner skeleton as claimed in claim 1, wherein said composition further includes titanium oxide.

3. A burner skeleton as claimed in claim 1, wherein said surface layer is formed by a plasma spray coating process.

4. A burner skeleton as claimed in claim 1, wherein said surface layer is formed of a glassy material.

5. A burner skeleton as claimed in claim 1, wherein said surface layer is formed of one of silica and alumina.

6. A burner skeleton as claimed in claim 1, wherein said surface layer is formed of a heat resistant paint containing water glass.

7. A burner skeleton as claimed in claim 1, wherein said surface layer is formed of a heat resistant paint of phosphorous acid type.

8. A burner skeleton as claimed in claim 1 wherein the porosity of the honeycomb structure as determined by the through-holes represents 50 to 82% of the apparent cross-sectional area of the burner skeleton.

9. A burner skeleton as claimed in claim 8 wherein the burner skeleton has a minimum specific surface area of 5 $m^2/g$, as measured by the BET method.

10. A burner skeleton as claimed in claim 10, wherein the burner skeleton is unsintered.

* * * * *